US008909070B2

(12) United States Patent
Osawa et al.

(10) Patent No.: US 8,909,070 B2
(45) **Date of Patent: *Dec. 9, 2014**

(54) IMAGE FORMING APPARATUS AND CARTRIDGE

(75) Inventors: Fujio Osawa, Kanagawa (JP); Kazunori Koshimori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 234 days.

This patent is subject to a terminal disclaimer.

(21) Appl. No.: 13/397,337

(22) Filed: Feb. 15, 2012

(65) Prior Publication Data

US 2013/0039667 A1 Feb. 14, 2013

(30) Foreign Application Priority Data

Aug. 12, 2011 (JP) ..... 2011-177005

(51) Int. Cl.
*G03G 15/00* (2006.01)
*G03G 15/08* (2006.01)
*G03G 21/18* (2006.01)

(52) U.S. Cl.
CPC ..... *G03G 15/0863* (2013.01); *G03G 21/1889* (2013.01)
USPC ..... 399/12; 399/25; 399/26; 399/27; 399/113; 399/262

(58) Field of Classification Search
USPC ..... 399/25, 26, 27, 30, 53, 120, 260
See application file for complete search history.

(56) References Cited

U.S. PATENT DOCUMENTS

| | | | | |
|---|---|---|---|---|
| 5,508,795 | A * | 4/1996 | Kikuchi | 399/27 |
| 5,708,912 | A * | 1/1998 | Lee | 399/24 |
| 7,027,755 | B2 * | 4/2006 | Ito et al. | 399/111 |
| 2010/0303499 | A1 | 12/2010 | Mori et al. | |
| 2013/0039668 | A1 * | 2/2013 | Takahashi | 399/25 |

FOREIGN PATENT DOCUMENTS

| | | | |
|---|---|---|---|
| JP | 11-109752 | A | 4/1999 |
| JP | 2010-276961 | A | 12/2010 |

* cited by examiner

*Primary Examiner* — David Gray
*Assistant Examiner* — Michael Harrison
(74) *Attorney, Agent, or Firm* — Sughrue Mion, PLLC

(57) ABSTRACT

An image forming apparatus includes a container storage that is installed on a toner container and stores first information relating to a use amount of a toner in the toner container and stores second information relating to a use amount of an image holding portion, which is a component not including the toner container and including at least an image holding body from among components installed in a cartridge; a housing storage that stores at least the second information and remains in the housing when the cartridge is removed from a housing; and an information write unit that writes the second information stored in the housing storage into the container storage if the first information stored in the container storage indicates that the toner in the toner container is unused and the second information stored in the container storage indicates that the image holding portion is used.

4 Claims, 13 Drawing Sheets

IMAGE FORMING APPARATUS AND CARTRIDGE

CROSS-REFERENCE TO RELATED APPLICATIONS

This application is based on and claims priority under 35 USC 119 from Japanese Patent Application No. 2011-177005 filed Aug. 12, 2011.

BACKGROUND

The present invention relates to an image forming apparatus and a cartridge.

SUMMARY

According to an aspect of the invention, there is provided an image forming apparatus including a housing; an image holding body that is housed in the housing and holds a toner image; an image forming unit that is housed in the housing and forms the toner image on the image holding body; a cartridge that includes at least the image holding body and is removably mounted on the housing; a toner container that is removably mounted on the cartridge, houses a toner therein, and supplies the toner to the image forming unit; a retaining mechanism that retains the toner container with respect to the cartridge; a releasing mechanism that at least allows the toner container retained by the retaining mechanism to be released while the cartridge is mounted on the housing, and remains in the housing when the cartridge is removed from the housing; a container storage that is installed on the toner container and stores first information relating to a use amount of the toner in the toner container and second information relating to a use amount of an image holding portion, which is a component not including the toner container and including at least the image holding body from among components installed in the cartridge; a housing storage that stores at least the second information and remains in the housing when the cartridge is removed from the housing; an information update unit that updates the first information in accordance with use of the toner in the toner container, and updates the second information in accordance with use of the image holding portion; and an information write unit that writes the second information stored in the housing storage into the container storage if the first information stored in the container storage indicates that the toner in the toner container is unused and the second information stored in the container storage indicates that the image holding portion is used.

BRIEF DESCRIPTION OF THE DRAWINGS

Exemplary embodiment(s) of the present invention will be described in detail based on the following figures, wherein.

DETAILED DESCRIPTION

Exemplary embodiments of the present invention will be described below with reference to the drawings.

General Configuration of Image Forming Apparatus

Figure 1:
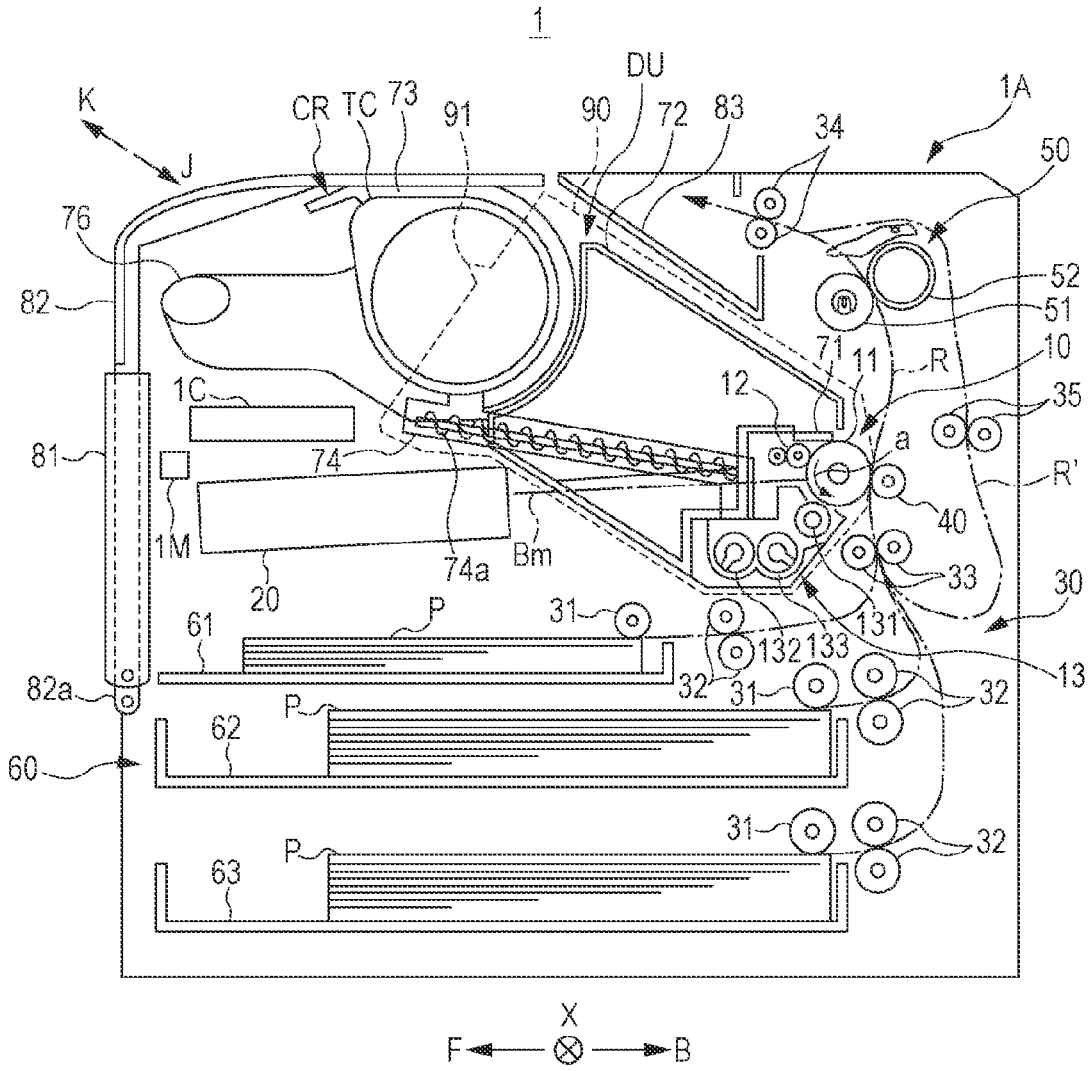
FIG. 1 is a cross-sectional view showing a general configuration of an image forming apparatus according to an exemplary embodiment of the invention.
Figure 2:
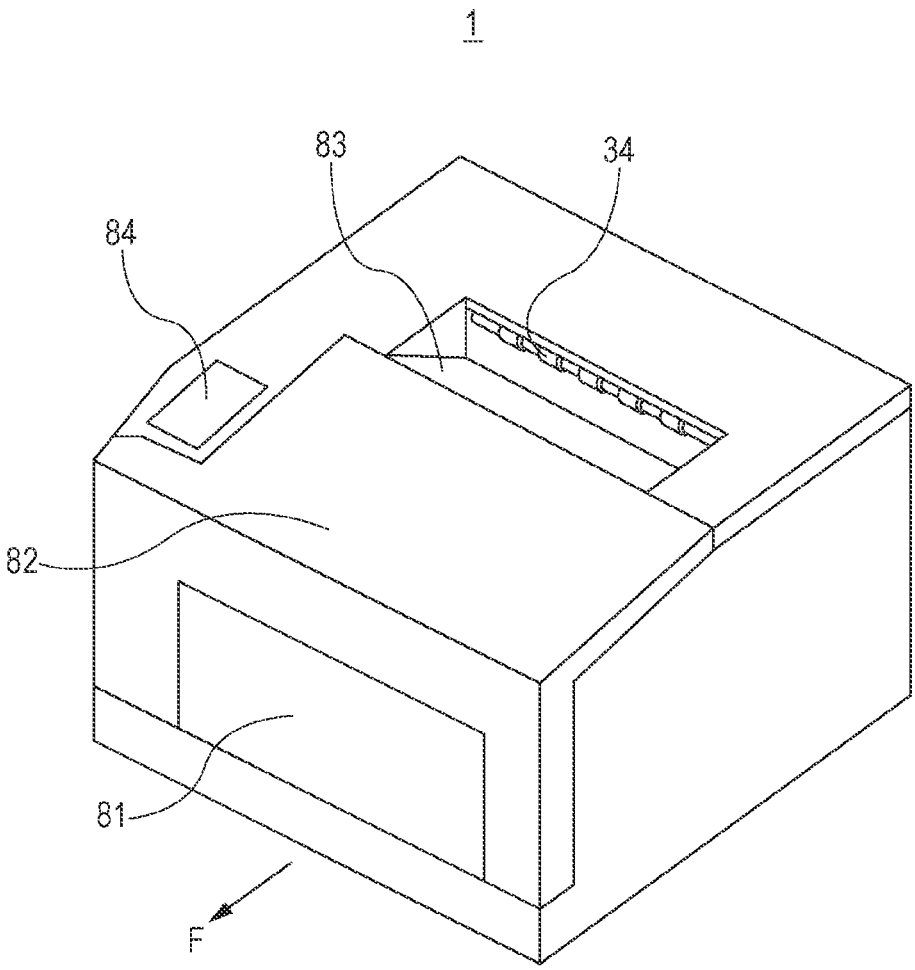
FIG. 2 is a perspective view showing an appearance of the image forming apparatus shown in FIG. 1.

FIG. 1 is a cross-sectional view showing a general configuration of an image forming apparatus according to an exemplary embodiment of the invention. FIG. 2 is a perspective view showing an appearance of the image forming apparatus shown in FIG. 1.

An image forming apparatus 1 shown in FIGS. 1 and 2 is a printer that prints an image on a sheet by using an electrophotographic system. The image forming apparatus 1 is an apparatus corresponding not only a sheet that is a recording medium of paper, but also a recording medium of resin such as an OHP sheet. In the following description, a sheet is representatively used as a recording medium unless otherwise noted.

The image forming apparatus 1 includes a toner-image forming and holding section 10, an exposure unit 20, a sheet transport device 30, a transfer unit 40, a fixing unit 50, and a sheet housing section 60. The toner-image forming and holding section 10 includes a photoconductor drum 11, a charging unit 12, and a developing unit 13.

The photoconductor drum 11 has a cylindrical surface, and is rotationally driven around the axis of the cylinder in a direction indicated by arrow a by a motor (not shown). The photoconductor drum 11 holds an electrostatic latent image and a toner image formed on the surface. The photoconductor drum 11 corresponds to an example of an image holding body.

The charging unit 12 charges the surface of the photoconductor drum 11 with electricity. The charging unit 12 is a charging roller that rotates while being in contact with the photoconductor drum 11 in this exemplary embodiment. Alternatively, a non-contact charging unit such as a corotron may be used.

The exposure unit 20 causes the photoconductor drum 11 to be exposed to light and forms an electrostatic latent image on the photoconductor drum 11. The exposure unit 20 scans the surface of the photoconductor drum 11, which has been electrically charged by the charging unit 12, with a light beam Bm based on an image signal provided from the outside, and forms a latent image on the surface of the photoconductor drum 11. The exposure unit 20 scans the surface of the photoconductor drum 11 with the light beam Bm in an axial direction X in which the rotation axis of the photoconductor drum 11 extends.

The developing unit 13 develops the latent image on the photoconductor drum 11 with a toner and forms a toner image on the photoconductor drum 11. The developing unit 13 includes stirring members 132 and 133 that stir a developer containing a toner and a magnetic carrier, and a developing roller 131 that transports the stirred developer onto the photoconductor drum 11. The developing unit 13 corresponds to an example of an image forming unit.

The transfer unit 40 is a roller that rotates with a sheet pinched between the roller and the photoconductor drum 11. The transfer unit 40 transfers the toner image on the photoconductor drum 11, onto a sheet.

The fixing unit 50 fixes the toner image transferred from the photoconductor drum 11 onto the sheet. The fixing unit 50 includes a heat roller 51 and a pressure roller 52, so as to apply heat and pressure to the toner while the sheet with the toner image to be fixed is pinched by and passes through the heat roller 51 and the pressure roller 52.

The sheet housing section 60 houses sheets on which images are formed. The sheet housing section 60 includes three sheet housing portions 61, 62, and 63 that house three types of sheets. The two lower sheet housing portions 62 and 63 from among the three sheet housing portions 61 to 63 are pulled out in a forward direction F from a front surface of the image forming apparatus 1 by an operator, sheets are supplied to the sheet housing portions 62 and 63, and the sheet housing portions 62 and 63 are pushed in a rearward direction B to be accommodated in the image forming apparatus 1. Hence, the two sheet housing portions 62 and 63 become ready for formation of images on sheets. The remaining upper sheet housing portion 61 from among the three sheet housing portions 61 to 63 is exposed to the outside when a manual feed panel 81 provided at the front surface of the image forming apparatus 1 is opened in the forward direction F, and then sheets are supplied to the sheet housing portion 61.

The sheet transport device 30 transports a sheet along a transport path R that passes through a transfer position. The transfer position is a position at which a toner image is transferred on a sheet from the photoconductor drum 11, and a position at which a sheet is pinched between the photoconductor drum 11 and the transfer unit 40. The sheet transport device 30 includes pickup rollers 31, separation rollers 32, registration rollers 33, output rollers 34, and reverse transport rollers 35. The pickup rollers 31 pick up sheets from the sheet housing portions 61 to 63. The separation rollers 32 separate the sheets picked up by the pickup rollers 31, one by one. The registration rollers 33 feed a sheet to the transfer unit 40 at a timing corresponding to a timing at which a toner image is formed on the photoconductor drum 11. The output rollers 34 output the sheet with the toner image fixed by the fixing unit 50, to the outside of the image forming apparatus 1. The sheet output by the output rollers 34 is output onto an output tray 83 provided in an upper area of the image forming apparatus 1. Part of the output sheet protruding from the output tray 83 is placed on a panel 82. The panel 82 is a member that covers the front surface and upper surface of the image forming apparatus 1. When the panel 82 is rotated in the forward direction F around a shaft 82*a* provided at the front surface of the image forming apparatus 1, mechanisms inside the image forming apparatus 1 are exposed. If duplex printing is executed, the output rollers 34 rotate backward when the output rollers 34 have transported a sheet halfway, and transport the sheet along a reverse transport path R'. The reverse transport rollers 35 transport the sheet along the reverse transport path R' and feed the sheet to the registration rollers 33. Thus, a new image is formed on a surface of the sheet opposite to the surface on which the image has been formed.

The image forming apparatus 1 according to this exemplary embodiment is an apparatus of a type called front feeder. Sheets are fed from the front surface side of the image forming apparatus 1. In the image forming apparatus 1, sheets P supplied to the sheet housing portions 61 to 63 from a position in the forward direction F with respect to the image forming apparatus 1 are transported in a rear area of the image forming apparatus 1, or more particularly along the transport path R provided in the rearward direction B with respect to the photoconductor drum 11 from the lower side to the upper side. A sheet P with an image formed thereon is output in the forward direction F onto the output tray 83 in the upper area of the image forming apparatus 1. In the image forming apparatus 1, new sheets are supplied and sheets with images formed thereon are removed by the operator at the position in the forward direction F with respect to the apparatus. Hence, the image forming apparatus 1 may be installed at a location where no spatial margin is provided on both sides in the axial direction X of the image forming apparatus 1. An image reading device may be arranged above the image forming apparatus 1 with a gap provided for removal of sheets and replacement of parts. Although described later, a process cartridge CR and a toner container (toner cartridge) TC are also removed and mounted in the forward direction F.

The image forming apparatus 1 also includes a cleaner 71, a recovery toner housing box 72, a container mount portion 73, a toner feeder 74, a body memory 1M, a controller 1C, and a display screen 84.

The cleaner 71 is in contact with the photoconductor drum 11 and removes the remaining toner on the photoconductor drum 11 after the toner image is transferred on the sheet, to clean the photoconductor drum 11. The cleaner 71 is a plate-like blade extending along the photoconductor drum 11.

The recovery toner housing box 72 houses the toner removed from the photoconductor drum 11 by the cleaner 71.

The toner container (toner cartridge) TC is removably mounted on the container mount portion 73. A toner for supply to the developing unit 13 is housed in the toner container TC. When the toner is consumed, the operator removes the toner container TC, and the toner container TC is replaced with a new toner container TC. The toner container (toner cartridge) TC corresponds to an example of a toner container.

The toner feeder 74 feeds the toner housed in the toner container TC to the developing unit 13. The toner feeder 74 has a structure in which a spiral blade member 74*a* is arranged in a tube extending from a lower portion of the toner container TC to an upper portion of the developing unit 13. The toner feeder 74 transports the toner from the toner container TC to the developing unit 13 by rotation of the blade member 74*a*.

The body memory 1M is a memory installed on an apparatus body 1A of the image forming apparatus 1. The body memory 1M stores drum cumulative use information indicative of a cumulative use amount of the photoconductor drum 11 in a drum unit DU. Although the details will be described later, the body memory 1M corresponds to an example of a housing storage of an image forming apparatus and corresponds to an example of a body memory of a cartridge.

The controller 1C controls respective portions of the image forming apparatus 1. Although the details will be described later, the controller 1C corresponds to an information update unit, an information write unit, and a use inhibit unit.

The above-described toner-image forming and holding section 10, the cleaner 71, the recovery toner housing box 72, the container mount portion 73, the toner container TC, and the toner feeder 74 are installed in the process cartridge CR. The process cartridge CR is removably mounted on the apparatus body 1A of the image forming apparatus 1. The process cartridge CR corresponds to an exemplary embodiment of a cartridge, and corresponds to an example of a cartridge of an image forming apparatus. The apparatus body 1A corresponds to an example of a housing. The toner container TC from among components installed in the process cartridge CR is removably mounted on the process cartridge CR. A component not including the toner container TC from among the components installed in the process cartridge CR, i.e., the toner-image forming and holding section 10, the cleaner 71, the recovery toner housing box 72, the container mount portion 73, and the toner feeder 74 are installed in the drum unit DU. The drum unit DU corresponds to an example of an image holding portion. In this exemplary embodiment, a direction in which the process toner cartridge CR is mounted on the apparatus body 1A is called mounting direction J, and a direction opposite to the mounting direction J is called removing direction K. Also, two directions including the mounting direction J and the removing direction K are collectively called mounting and removing directions JK. The process cartridge CR includes a handle 76. The operator grips the handle 76 when the operator removes or mounts the process cartridge CR from or on the apparatus body 1A. A specific structure of the process cartridge CR and a specific structure relating to mounting and removal of the toner container TC on and from the process cartridge CR will be described later.

Basic Operation of Image Forming Apparatus

A basic operation of the image forming apparatus 1 shown in FIG. 1 is described.

In the toner-image forming and holding section 10, the photoconductor drum 11 is rotationally driven in the direction indicated by arrow a and the charging unit 12 applies an electric charge to the surface of the photoconductor drum 11. The exposure unit 20 radiates the surface of the photoconductor drum 11 with exposure light based on an image signal provided from the outside, to form an electrostatic latent image on the surface of the photoconductor drum 11. The photoconductor drum 11 rotates while holding the electrostatic latent image.

The developing unit 13 develops the electrostatic latent image on the photoconductor drum 11 with the toner, to form a toner image. The toner feeder 74 feeds the toner to the developing unit 13 from the toner container TC. The photoconductor drum 11 rotates while holding to toner image formed by the developing unit 13.

A sheet P housed in any of the sheet housing portions 61, 62, and 63 is picked up by the pickup rollers 31, and transported along the transport path R to the transfer unit 40 by the separation roller 32 and the registration rollers 33. The sheet P is fed by the registration rollers 33 to the transfer unit 40 at a timing corresponding to a timing at which the toner image is formed on the photoconductor drum 11. The transfer unit 40 applies a bias voltage for transfer between the photoconductor drum 11 and the sheet, to transfer the toner image on the photoconductor drum 11, onto the sheet. The sheet with the toner image transferred by the transfer unit 40 is transported to the fixing unit 50. The fixing unit 50 fixes the transferred toner image to the sheet. In this way, the image is formed on the sheet. The sheet with the image formed thereon is output onto the output tray 83 by the output rollers 34.

After the transfer by the transfer unit 40, the cleaner 71 removes the toner remaining on the photoconductor drum 11. The toner removed from the photoconductor drum 11 by the cleaner 71 is housed in the recovery toner housing box 72.

Mounting and Removable of Process Cartridge

Figure 3:
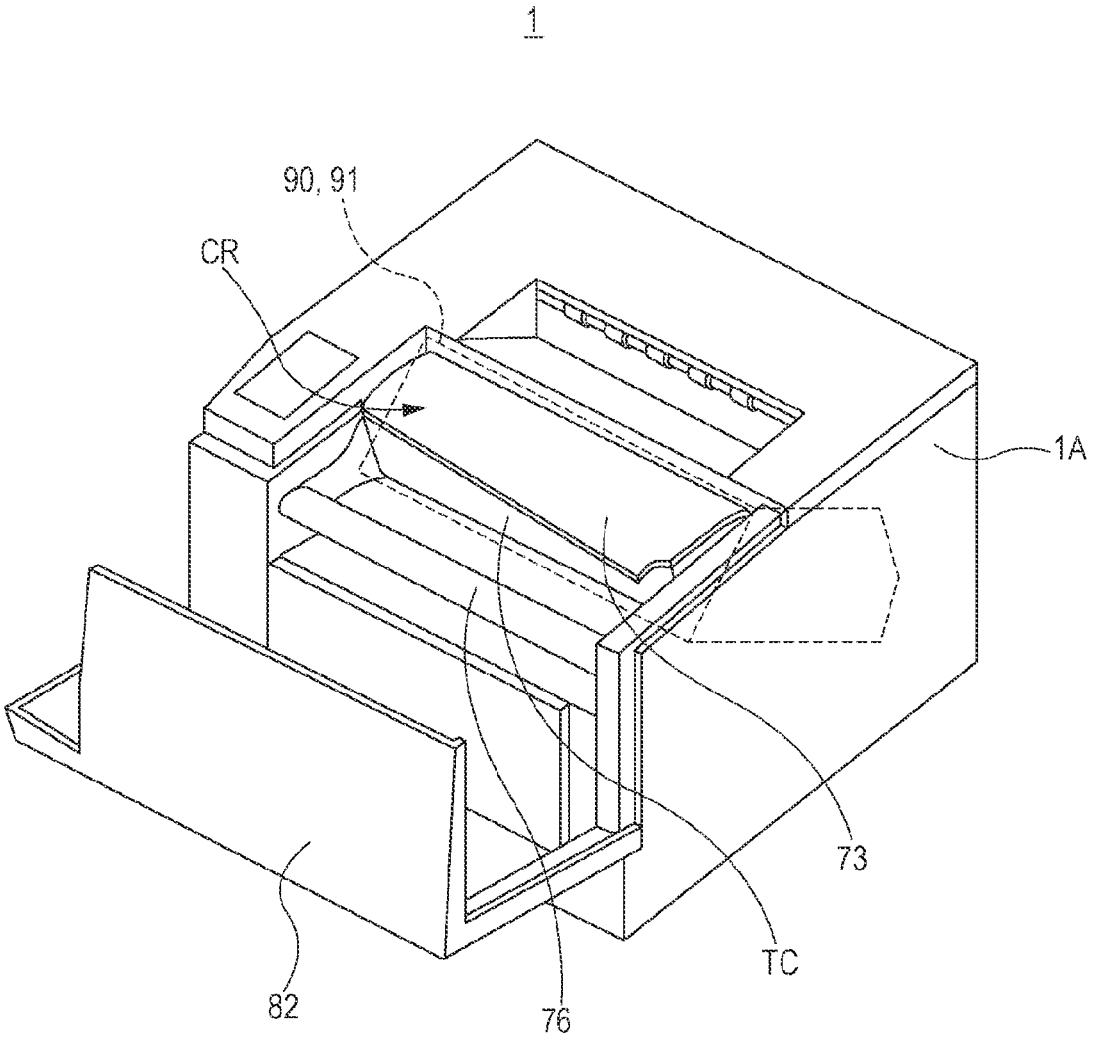
FIG. 3 is a perspective view showing a state in which a panel of the image forming apparatus shown in FIG. 2 is open.

FIG. 3 is a perspective view showing a state in which a panel of the image forming apparatus shown in FIG. 2 is open.

Description is continuously provided with reference to FIGS. 3 and 1. The process cartridge CR is exposed to the outside of the image forming apparatus 1 when the panel 82 that covers the front surface and upper surface of the image forming apparatus 1 is opened in the forward direction F. To be more specific, when the panel 82 is opened, the container mount portion 73, the toner container TC, and the handle 76 of the drum unit DU from among the components of the process cartridge CR are exposed. The process cartridge CR is arranged in a cavity provided in a mount portion 90 of the apparatus body 1A. The cavity of the mount portion 90 has a mount opening 91 that is open to the obliquely upper side in the forward direction F of the apparatus body 1A of the image forming apparatus 1.

Figure 4:
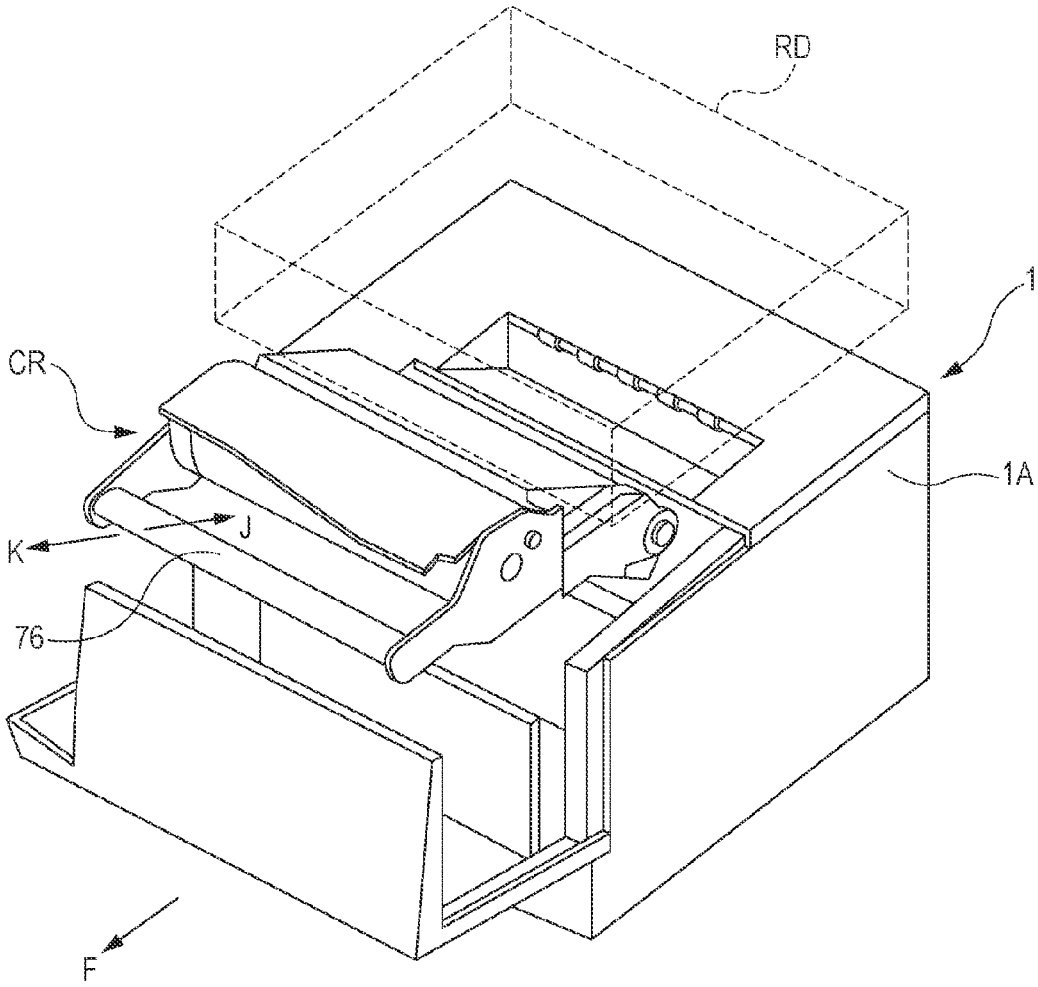
FIG. 4 is a perspective view showing a state in the middle of removal of a process cartridge.

FIG. 4 is a perspective view showing a state in the middle of removal of the process cartridge. FIG. 4 illustrates an arrangement position of an image reading device RD indicated by broken lines. The image reading device RD may be arranged above the image forming apparatus 1. The image reading device RD is a device that reads an image from a document. The image reading device RD provides read image data to the image forming apparatus 1, so that the image forming apparatus 1 functions as, for example, a copier.

When the operator grips and pulls the handle 76, the process cartridge CR is pulled from the apparatus body 1A of the image forming apparatus 1 to the obliquely upper side in the forward direction F, i.e., in the removing direction K. If the image reading device RD is arranged above the image forming apparatus 1, a space for removal of sheets is provided between the image forming apparatus 1 and the image reading device RD. When the process cartridge CR is removed or mounted, the process cartridge CR moves in the space for removal of sheets between the image forming apparatus 1 and the image reading device RD.

Configuration of Process Cartridge

Figure 5:
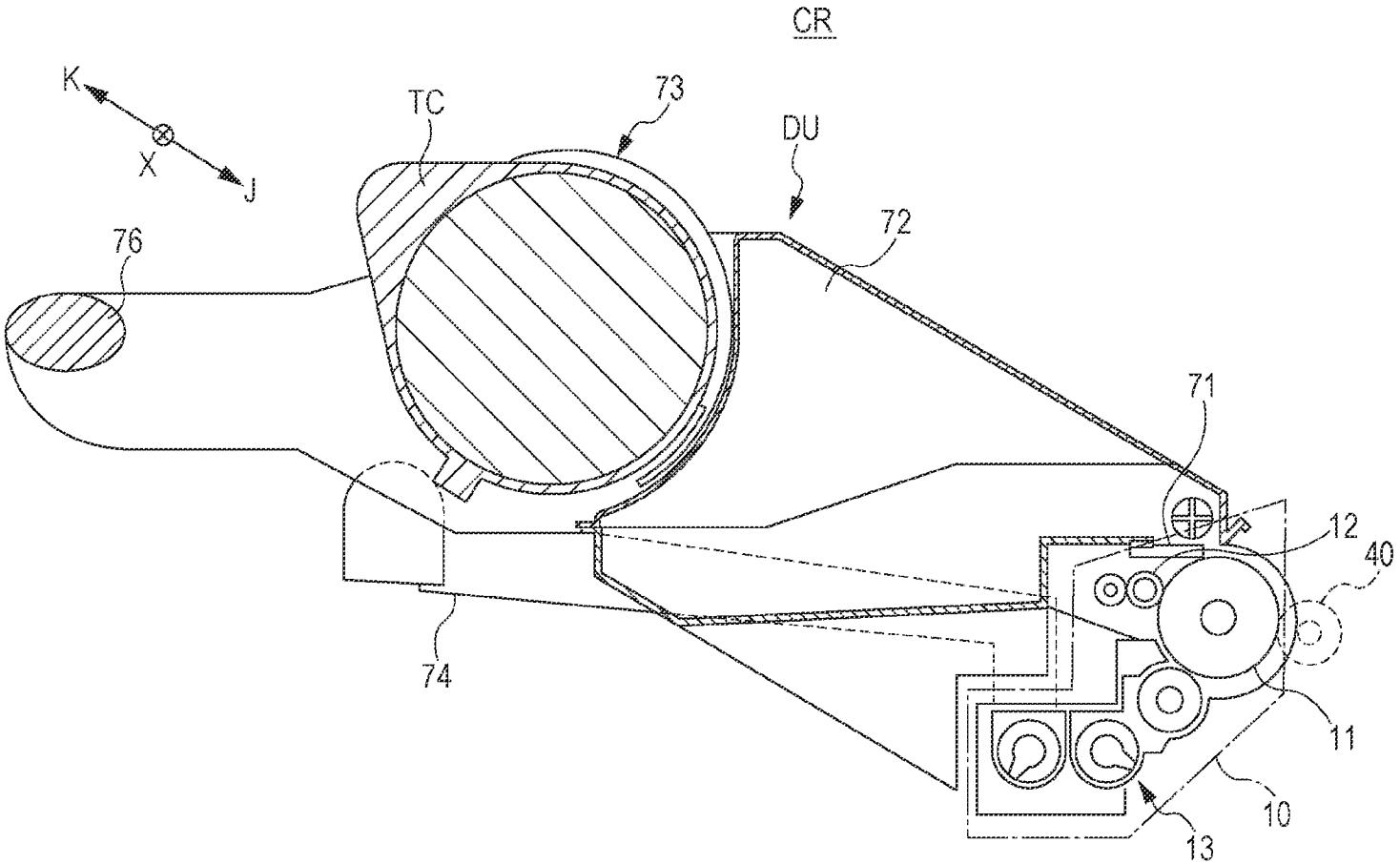
FIG. 5 is a cross-sectional view showing a configuration of the process cartridge.
Figure 6:
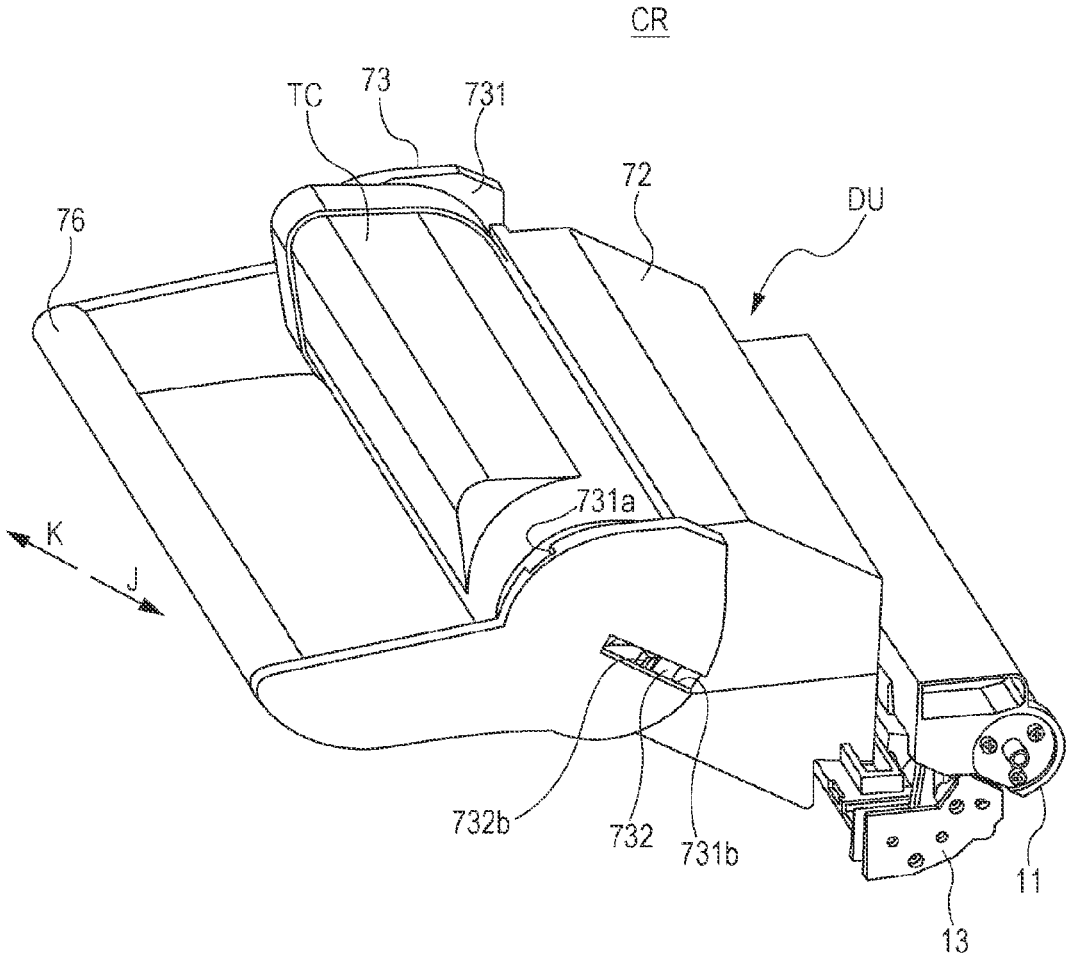
FIG. 6 is a perspective view showing an appearance of the process cartridge.

FIG. 5 is a cross-sectional view showing a configuration of the process cartridge. FIG. 6 is a perspective view showing an appearance of the process cartridge.

FIG. 5 also illustrates using broken lines the position of the transfer unit 40 while the process cartridge CR is mounted on the apparatus body 1A (see FIG. 1) of the image forming apparatus 1. The process cartridge CR shown in FIG. 6 is in a state in which the process cartridge CR is removed from the apparatus body 1A.

The process cartridge CR is a replacement unit in which the toner container TC and the drum unit DU are integrated as a unit. The drum unit DU includes the toner-image forming and holding section 10, the cleaner 71, the recovery toner housing box 72, the container mount portion 73, the toner feeder 74, and the handle 76. The toner-image forming and holding section 10 includes the photoconductor drum 11, the charging unit 12, and the developing unit 13 as described above.

In the process cartridge CR, the toner-image forming and holding section 10, the recovery toner housing box 72, and the toner container TC are arranged in the mounting and removing directions JK of the process cartridge CR, and the recovery toner housing box 72 extends in the space between the toner container TC and the toner-image forming and holding section 10. While the process cartridge CR is mounted on the apparatus body 1A, the toner container TC mounted on the container mount portion 73 is located at the most rear position in the mounting direction J. In other words, while the process cartridge CR is mounted on the apparatus body 1A, the toner container TC of the process cartridge CR is arranged at the most front position in the mount portion 90 of the apparatus body 1A of the image forming apparatus 1. Hence, while the panel 82 of the apparatus body 1A is open as shown in FIG. 3, the toner container TC from among the components of the process cartridge CR is exposed to the outside.

Toner Container and Container Mount Portion

Figure 7:
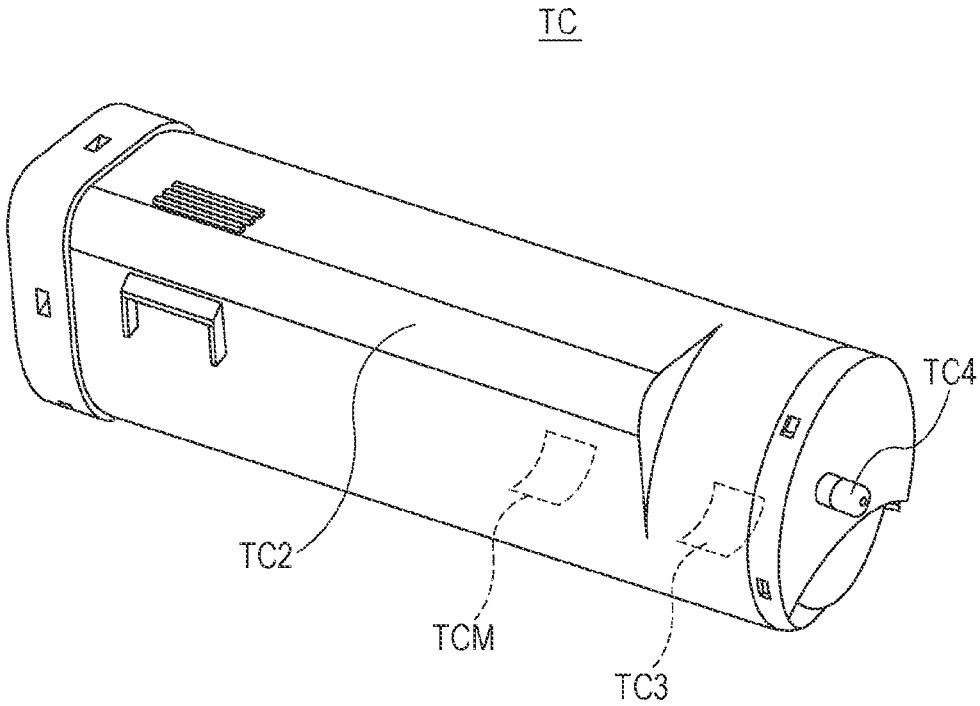
FIG. 7 is a perspective view showing a toner container.

FIG. 7 is a perspective view showing the toner container.

The toner container TC shown in FIG. 7 has a cylindrical shape with a peripheral surface and a bottom. A protrusion TC2 indicative of the direction of the toner container TC is provided at part of the peripheral surface. A toner is housed in the toner container TC. A panel TC3 that closes a path of the toner is provided at the peripheral surface of the toner container TC. The toner container TC also has a circular side surface. A protrusion TC4 is provided at the side surface. Also, a cartridge memory TCM is installed on the peripheral surface of the toner container TC. The cartridge memory TCM stores toner remaining amount information indicative of a remaining amount of the toner in the toner container TC and drum cumulative use information indicative of a cumulative use amount of the photoconductor drum 11 of the drum unit DU. Further, the cartridge memory TCM stores a toner container flag indicative of whether or not the toner container TC is unused (i.e., whether or not the toner container TC is a new product or a used product), and a drum unit flag indicative of whether or not the drum unit DU is unused (i.e., whether or not the drum unit DU is a new product or a used product). The cartridge memory TCM corresponds to an example of a container storage. Also, the toner remaining amount information and the toner container flag correspond to an example of first information, and the drum cumulative use information and the drum unit flag correspond to an example of second information. The toner container TC is mounted on the container mount portion 73 of the drum unit DU shown in FIG. 5, and hence is mounted on the process cartridge CR.

Figure 8:
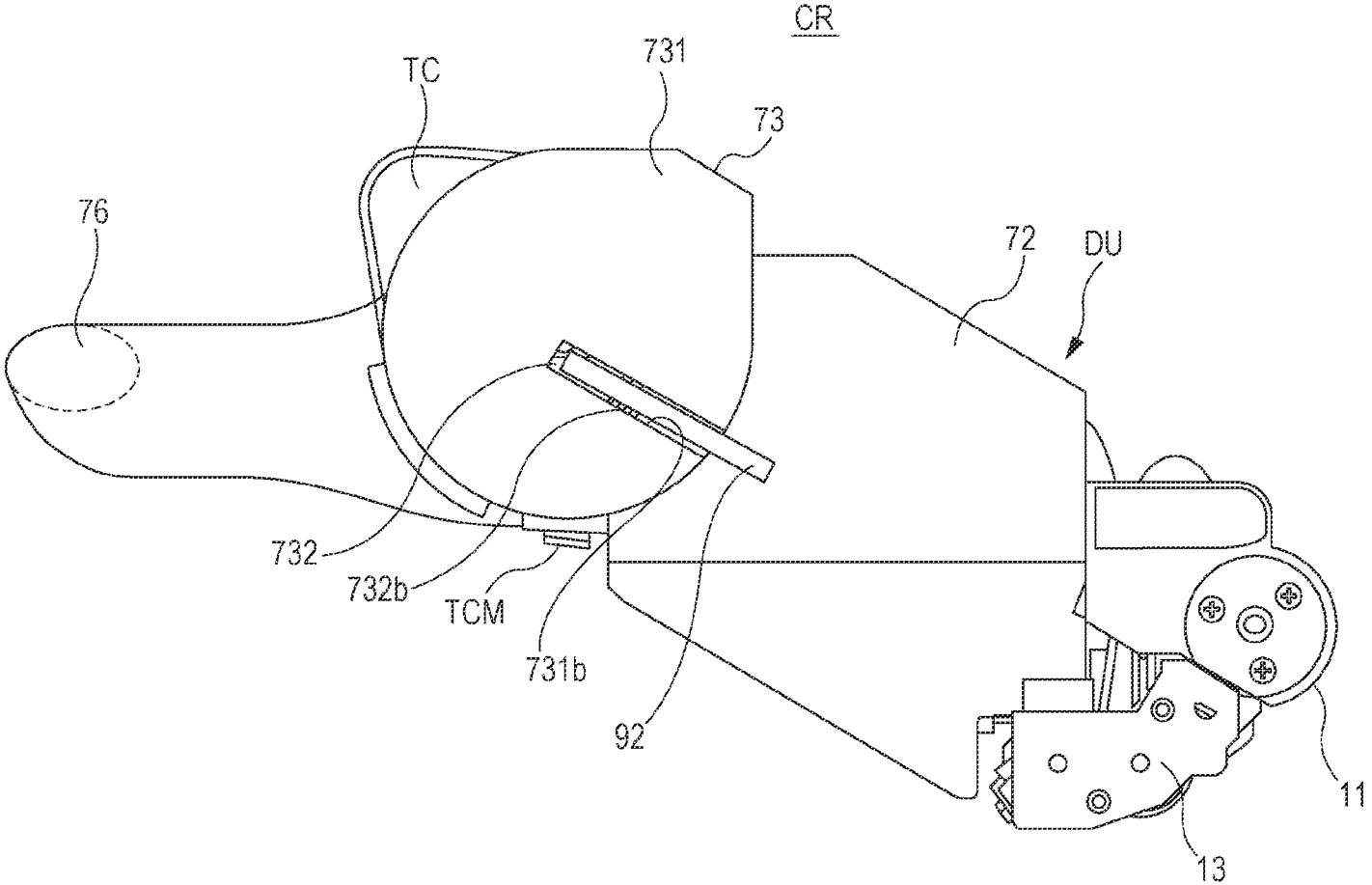
FIG. 8 is a side view showing the process cartridge.
Figure 9:
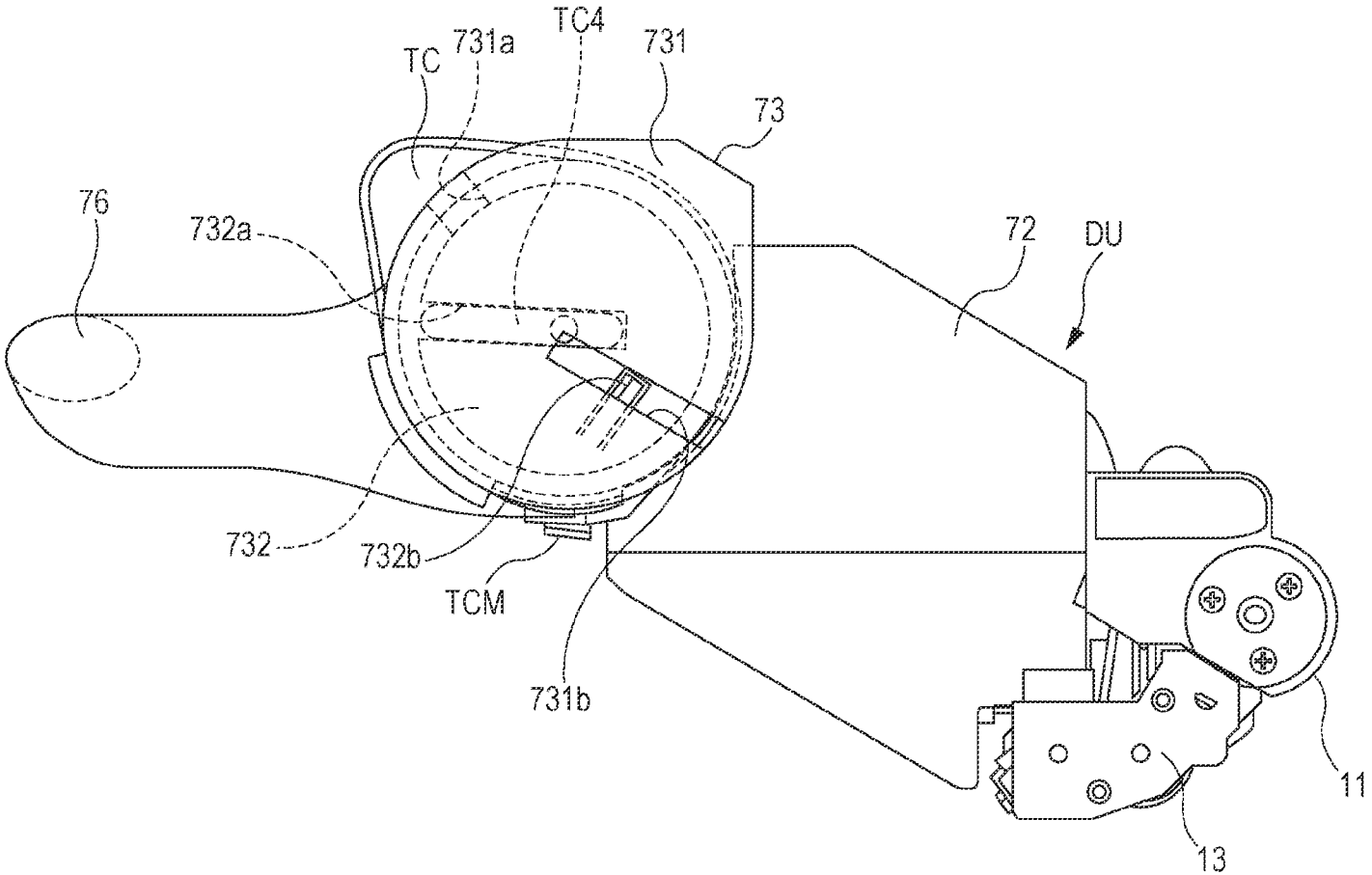
FIG. 9 is a partly perspective view showing the process cartridge shown in FIG. 8, FIG. 9 illustrating in a perspective manner the toner container and a container mount portion from among components installed in the process cartridge.

FIG. 8 is a side view showing the process cartridge. FIG. 9 is a partly perspective view showing the process cartridge shown in FIG. 8, FIG. 9 illustrating in a perspective manner the toner container and the container mount portion from among the components installed in the process cartridge. The process cartridge CR shown in FIGS. 8 and 9 is in a state in which the process cartridge CR is arranged in the cavity provided in the mount portion 90 (see FIG. 1) of the apparatus body 1A although the cavity is not illustrated in FIGS. 8 and 9.

The container mount portion 73 is described with reference to FIGS. 8, 9, and 6.

The container mount portion 73 includes a fixing member 731 that is fixed to the recovery toner housing box 72, and a restraining member 732 that is provided at an inner side surface of the fixing member 731 and restrains the toner container TC with respect to the fixing member 731.

The fixing member 731 includes a container guide groove 731*a* that guides a distal end of the protrusion TC4 when mounting of the toner container TC is started, and a notch 731*b* linearly extending in the mounting and removing directions JK. Also, the handle 76 is fixed to the fixing member 731.

The mount portion 90 (see FIG. 1) of the apparatus body 1A has a protrusion 92 at an inner surface of the mount portion 90. The protrusion 92 linearly extends in the mounting and removing directions JK and enters the notch 731*b* of the fixing member 731 while the process cartridge CR is arranged in the cavity provided in the mount portion 90. The protrusion 92 corresponds to an example of a releasing mechanism.

The restraining member 732 is a disk-like member having a container guiding and holding notch 732*a* that guides and holds the protrusion TC4 of the toner container TC. The restraining member 732 is held at the inner side surface of the fixing member 731 rotatably relative to the fixing member 731. To be more specific, the toner container TC is held by the container guiding and holding notch 732*a* while the toner container TC is mounted on the container mount portion 73, and the toner container TC is guided by the container guiding and holding notch 732*a* in the middle of the state in which the toner container TC is mounted on the container mount portion 73. The toner container TC is housed in the container mount portion 73 at the inner side with respect to the restraining member 732. Also, the restraining member 732 includes a protrusion 732*b*. Through grooves are made at three sides of the periphery of the protrusion 732*b*. Hence, the protrusion 732*b* is located at a distal end of a leaf spring. The leaf spring urges the protrusion 732*b* toward the fixing member 731. While the toner container TC is mounted on the container mount portion 73, the protrusion 732*b* is present at a position at which the protrusion 732*b* faces the notch 731*b* of the fixing member 731, and the container guide groove 731*a* and the container guiding and holding notch 732*a* extend in different directions. Owing to this, the toner container TC is retained in the container mount portion 73. That is, the combination of the fixing member 731 and the restraining member 732 corresponds to an example of a retaining mechanism.

While the toner container TC is mounted on the container mount portion 73, the cartridge memory TCM installed on the toner container TC is located at a position at which the cartridge memory TCM faces the inner surface of the mount portion 90. A connection terminal is provided at the outer surface of the cartridge memory TCM. A connection terminal that comes into contact with the connection terminal of the cartridge memory TCM is provided at the inner surface of the mount portion 90. While the toner container TC is mounted on the container mount portion 73, the connection terminals come into contact with each other and hence are electrically connected with each other. Thus, the cartridge memory TCM is connected with the controller 1C of the image forming apparatus 1 (see FIG. 1).

As shown in FIGS. 8 and 9, while the process cartridge CR is arranged in the mount portion 90 (see FIG. 1) of the apparatus body 1A, the protrusion 92 formed at the inner surface of the mount portion 90 enters the notch 731*b* of the fixing member 731. The protrusion 732*b* of the restraining member 732 is pushed by the protrusion 92 entering the notch 731*b*, against the urging force of the leaf spring. Accordingly, the restraining member 732 becomes rotatable relative to the fixing member 731. That is, the toner container TC housed in the container mount portion 73 is allowed to rotate.

When the process cartridge CR is removed to the outside of the apparatus body 1A (see FIG. 1) from the state shown in FIGS. 8 and 9, the protrusion 92 formed at the inner surface of the mount portion 90 of the apparatus body 1A is released from the notch 731*b* of the fixing member 731. Accordingly, the protrusion 732*b* of the restraining member 732 protrudes by the urging force of the leaf spring in the notch 731*b* of the fixing member 731. The restraining member 732 becomes non-rotatable relative to the fixing member 731. That is, the toner container TC housed in the container mount portion 73 is inhibited from rotating. In this state, since the container guiding and holding notch 732*a* holding the protrusion TC4 of the toner container TC is fixed in the direction different from the direction of the container guide groove 731*a*, the toner container TC is brought into a locked state in which the toner container TC is not allowed to be removed from the container mount portion 73.

Figure 10:
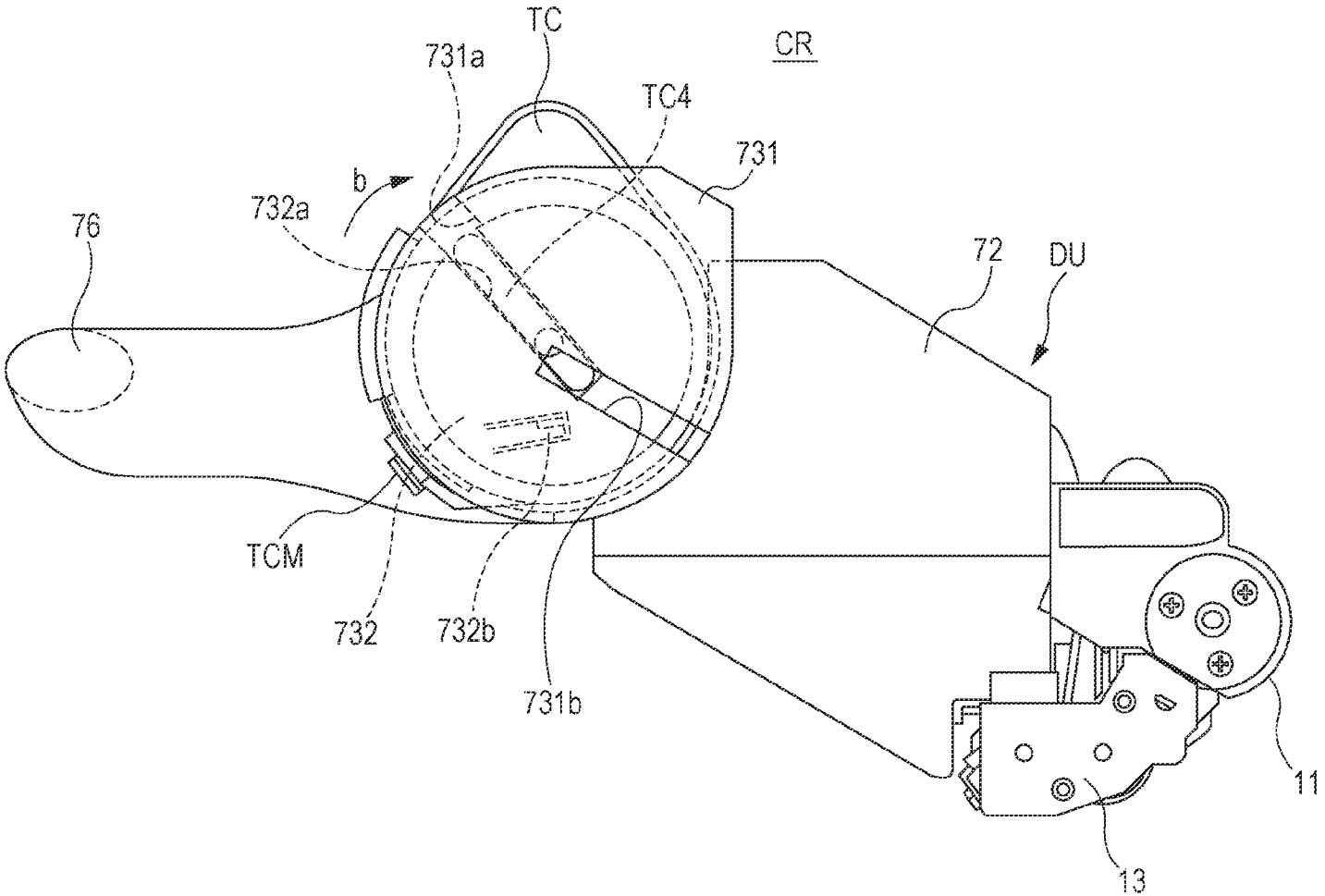
FIG. 10 is a partly perspective view showing the process cartridge in a state in which the toner container is allowed to be removed from the process cartridge.

FIG. 10 is a partly perspective view showing the process cartridge in the state in which the toner container is allowed to be removed from the process cartridge. FIG. 10 illustrates in a perspective manner the toner container TC and the container mount portion 73 from among the components installed in the process cartridge CR like FIG. 9. The process cartridge CR shown in FIG. 10 is in the state in which the process cartridge CR is arranged in the cavity provided in the mount portion 90 (see FIG. 1) of the apparatus body 1A although the cavity is not illustrated in FIG. 10 like FIG. 9.

FIG. 10 illustrates a state in which the toner container TC is rotated in a direction indicated by arrow b from the state shown in FIGS. 8 and 9 by an operation of the operator. When the toner container TC is rotated in the direction indicated by arrow b, the restraining member 732 is also rotated in the direction indicated by arrow b by the protrusion TC4 held at the container guiding and holding notch 732*a*. Accordingly, the direction of the container guiding and holding notch 732*a* that holds the protrusion TC4 of the toner container TC is aligned with the direction of the container guide groove 731*a*. That is, the protrusion TC4 of the toner container TC is guided by the container guiding and holding notch 732*a* and the container guide groove 731*a*, and the toner container TC is allowed to be removed from the container mount portion 73. In other words, the toner container TC is allowed to be removed from the process cartridge CR while the drum unit DU remains in the apparatus body 1A (see FIG. 1).

Figure 11:
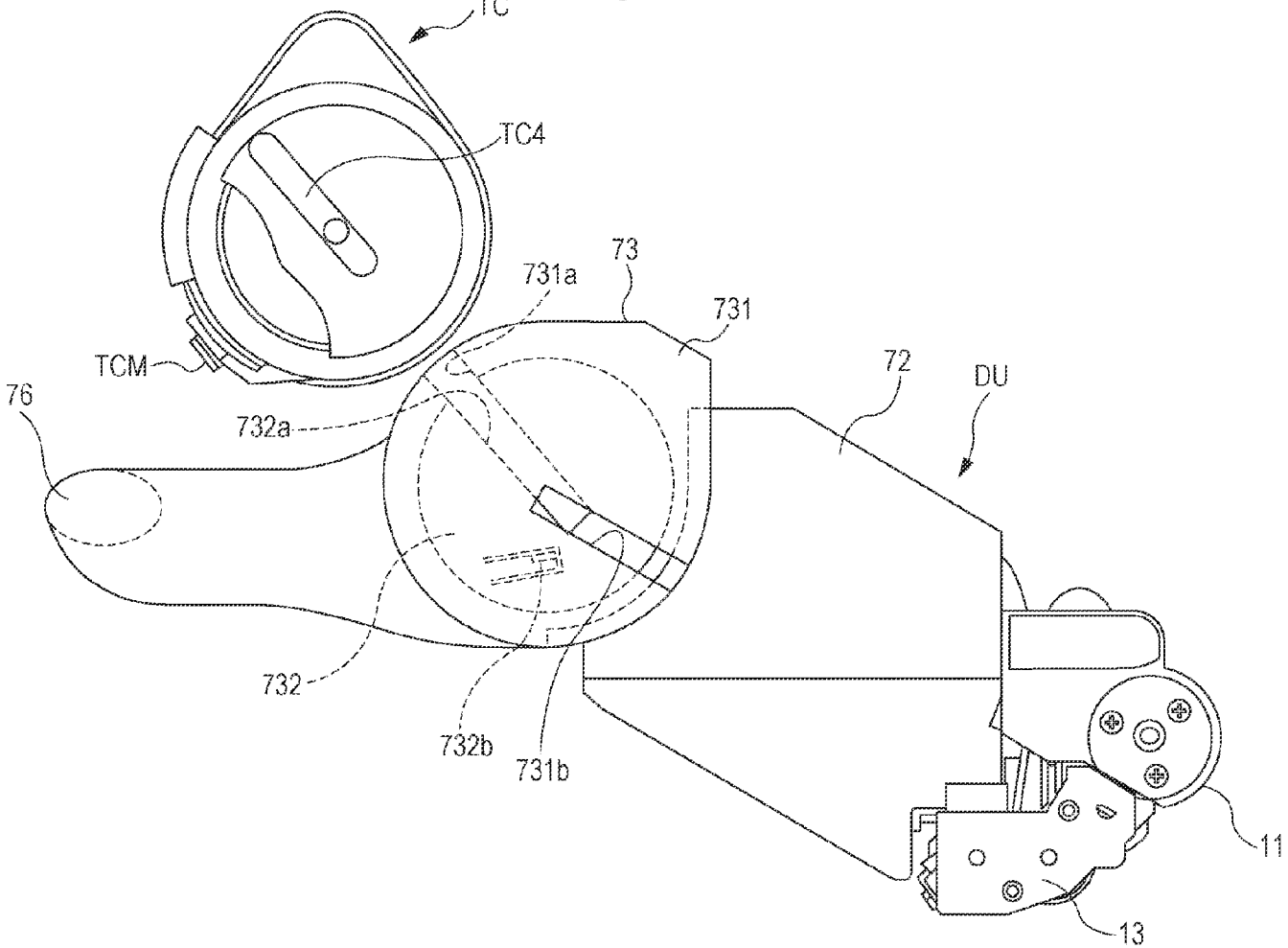
FIG. 11 is a partly perspective view showing the process cartridge while the toner container is removed from the process cartridge.

FIG. 11 is a partly perspective view showing the process cartridge while the toner container is removed from the process cartridge. FIG. 11 illustrates in a perspective manner the container mount portion 73 from among the components installed in the process cartridge CR. The drum unit DU of the process cartridge CR shown in FIG. 10 is in a state in which the drum unit DU is arranged at the mount portion 90 (see FIG. 1) of the apparatus body 1A although not shown in FIG. 10.

As shown in FIG. 11, the toner container TC is removed from the process cartridge CR while the drum unit DU remains in the apparatus body 1A (see FIG. 1).

As described above with reference to FIGS. 6, and 8 to 11, in the image forming apparatus 1 according to this exemplary embodiment, the toner container TC is allowed to be removed from the process cartridge CR only while the process cartridge CR is arranged in the mount portion 90 (see FIG. 1A) of the apparatus body 1A. In other words, while the process cartridge CR is removed from the apparatus body 1A (see FIG. 1), the toner container TC is inhibited from being removed from the process cartridge CR.

Use of Cartridge Memory TCM

Now, use of various kinds of information stored in the cartridge memory TCM is described. If the toner container TC is mounted on the container mount portion 73 and the process cartridge CR is arranged in the mount portion 90 (see FIG. 1), the cartridge memory TCM is connected with the controller 1C as described above. The controller 1C is able to write and read various information in and from the cartridge memory TCM. The controller 1C controls entire image formation operation in the image forming apparatus 1. The controller 1C updates the drum cumulative use information in the cartridge memory TCM every time when an image is formed. Also, the controller 1C writes the backup of the drum cumulative use information in the body memory 1M. If the drum unit flag indicates a new product when the drum cumulative use information is updated, the controller 1C changes the drum unit flag to a flag indicative of a used product. Further, the controller 1C operates the toner feeder 74 if necessary to feed the toner to the developing unit 13 from the toner container TC, and updates the toner remaining amount information in the cartridge memory TCM every time when the toner is fed. If the toner container flag indicates a new product when the toner remaining amount information is updated, the controller 1C changes the toner container flag to a flag indicative of a used product.

As described above, if the drum cumulative use information is updated and becomes drum cumulative use information corresponding to that the life of the photoconductor drum 11 reaches its end, the controller 1C causes the display screen 84 (see FIG. 2) to display a message for requesting the operator to replace the process cartridge CR. If the toner remaining amount information is updated and becomes toner remaining amount information corresponding to that the toner container TC is empty, the controller 1C causes the display screen 84 to display a message for requesting the operator to replace the toner container TC.

The operator of the image forming apparatus 1 sees the messages displayed on the display screen 84, recognizes the replacement timing of the process cartridge CR or the toner container TC, and replaces the process cartridge CR or the toner container TC with a new product.

If the process cartridge CR is replaced with a new product, both the drum unit DU and the toner container TC are simultaneously replaced with new products. Hence, the toner container flag indicative of a new product and the drum unit flag indicative of a new product are stored in the cartridge memory TCM. In this case, the drum cumulative use information indicates "zero use," and the toner remaining amount information indicates the full toner amount in the toner container TC.

In contrast, if the toner container TC is replaced with a new product independently from the process cartridge CR, the toner container TC is provided from the manufacturer of the toner container TC for toner supply. The toner container flag indicative of a new product and the drum unit flag indicative of a used product are stored in the cartridge memory TCM. In this case, the drum cumulative use information indicates "unknown use amount," and the toner remaining amount information indicates the full toner amount in the toner container TC.

Operation of Controller during Replacement of Process Cartridge

Figure 12:
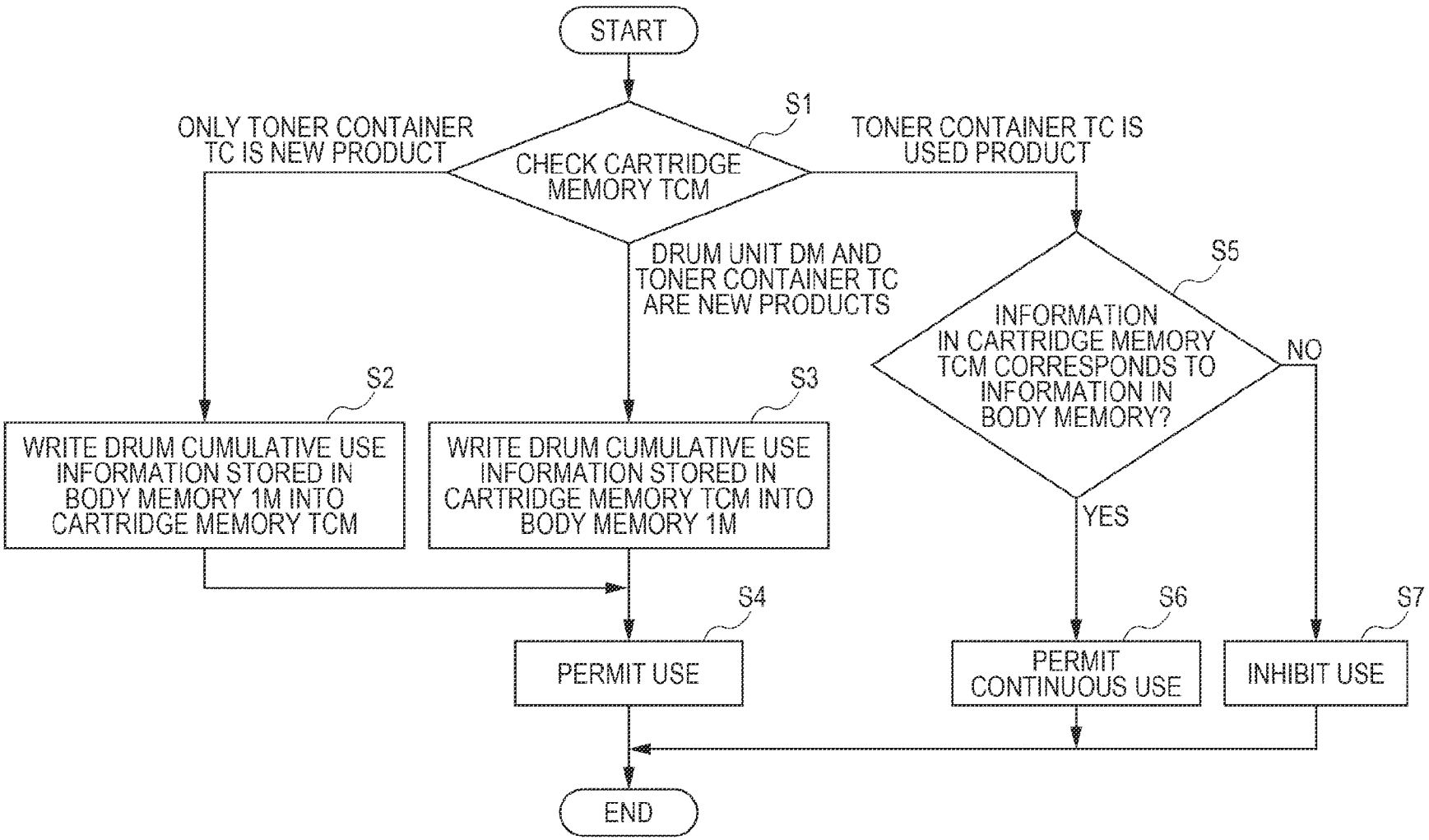
FIG. 12 is a flowchart showing an operation of a controller when the process cartridge is replaced.

FIG. 12 is a flowchart showing an operation of a controller when the process cartridge is replaced.

The controller 1C reads and checks various information stored in the cartridge memory TCM at a certain timing with a possibility of replacement of the process cartridge CR or the toner container TC, for example, when power of the image forming apparatus 1 is turned on or when connection of the cartridge memory TCM is detected (step S1). For the check in step S1, by checking the toner container flag and the drum unit flag, it is judged whether or not the toner container TC and the drum unit DU are new products. In step S1, if it is judged that the toner container TC is a new product and the drum unit DU is a used product, the judgment represents that the toner container TC is replaced with a new product independently from the process cartridge CR. The controller 1C rewrites the drum cumulative use information indicative of "unknown use amount" stored in the cartridge memory TCM into the drum cumulative use information stored in the body memory 1M (step S2). Accordingly, the drum cumulative use information is correctly provided in the new cartridge memory TCM. Then, the use of the process cartridge CR is permitted (step S4).

Also, in step S1, if it is judged that the toner container TC and the drum unit DU are new products, this judgment represents that the process cartridge CR is replaced with a new product. The controller 1C writes the drum cumulative use information indicative of "zero use" stored in the cartridge memory TCM into the body memory 1M (step S3). Alternatively, writing of information in step S3 may be executed by resetting the drum cumulative use information of the body memory 1M into information indicative of "zero use." Then, the use of the process cartridge CR is permitted (step S4).

Further, in step S1, if it is judged that the toner container TC and the drum unit DU are used products, the controller 1C compares the drum cumulative use information stored in the cartridge memory TCM with the drum cumulative use information stored in the body memory 1M (step S5).

In step S5, if the drum cumulative use information stored in the cartridge memory TCM corresponds to the drum cumulative use information stored in the body memory 1M, for example, the judgment may represent that the process cartridge CR before power is turned off last time is continuously arranged. Continuous use of the process cartridge CR is permitted (step S6).

In contrast, in step S5, if the drum cumulative use information stored in the cartridge memory TCM does not correspond to the drum cumulative use information stored in the body memory 1M, a used toner container TC or a used process cartridge CR that is used in another apparatus may be mounted. In this case, it is difficult to check the use state of the drum unit DU. If the toner container TC or the process cartridge CR is continuously used, a malfunction may occur due to the incorrect drum cumulative use information. Owing to this, in this exemplary embodiment, the process cartridge CR is inhibited from being used (step S7). This exemplary embodiment is a desirable exemplary embodiment in view of prevention for occurrence of a malfunction etc.

Next, another exemplary embodiment of the invention is described. This exemplary embodiment differs from the aforementioned exemplary embodiment for part of operation of the controller 1C during replacement of the process cartridge CR. Other configuration and operation of this exemplary embodiment are similar to those of the aforementioned exemplary embodiment. Hereinafter, different points are described.

Operation of Controller during Replacement of Process Cartridge (Another Exemplary Embodiment)

Figure 13:
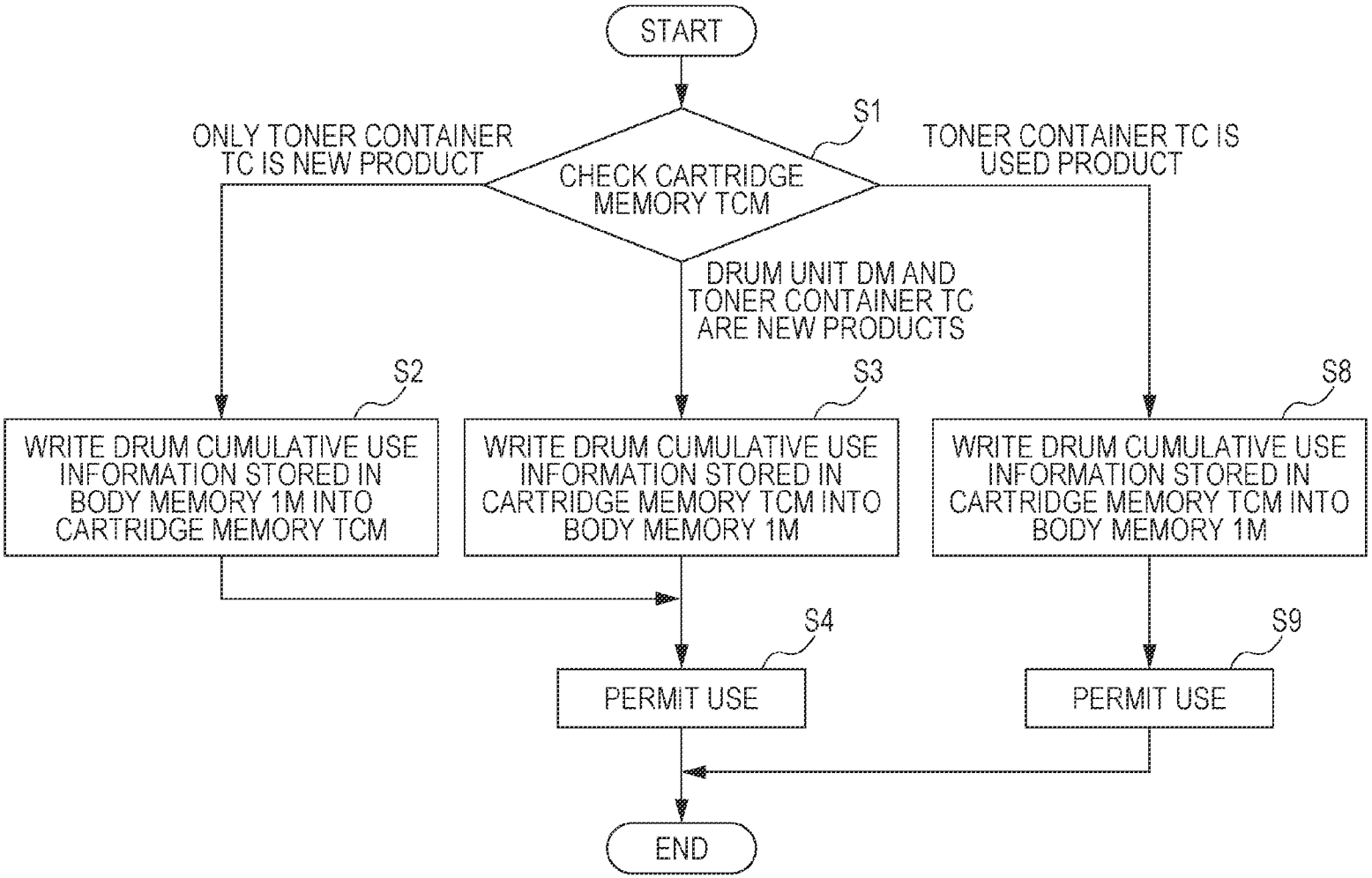
FIG. 13 is a flowchart showing an operation of a controller when a process cartridge is replaced according to another exemplary embodiment.

FIG. 13 is a flowchart showing an operation of a controller when a process cartridge is replaced according to another exemplary embodiment.

In this exemplary embodiment, if it is judged that the toner container TC and the drum unit DU are used products, the controller 1C rewrites the drum cumulative use information stored in the cartridge memory TCM with the drum cumulative use information stored in the body memory 1M (step S8). Then, the use of the process cartridge CR is permitted (step S9).

In this exemplary embodiment, diversion of the used process cartridge CR is allowed while the malfunction is avoided by inhibiting the used toner container TC for supply from being used through an operation manual or the like. It is desirable to allow the diversion of the used process cartridge CR because the process cartridge CR is efficiently operated.

In the above-described exemplary embodiments, a monochromatic printer is used as an example of an image forming apparatus. However, the image forming apparatus is not limited thereto. For example, a color printer that forms a color image may be used.

In the above-described exemplary embodiments, a printer is used as an example of an image forming apparatus. However, the image forming apparatus is not limited to a printer. For example, a copier or a facsimile may be used.

In the above-described exemplary embodiments, the releasing mechanism is a mechanism that physically releases the locked state for example. However, the releasing mechanism is not limited thereto. For example, a mechanism that releases the locked state by an electric instruction may be used.

In the above-described exemplary embodiments, the releasing mechanism is a mechanism that allows the retained state of the toner container with respect to the process cartridge to be released by a manual operation of the operator. However, the releasing mechanism is not limited thereto, and may be a mechanism that completely releases the retained state of the toner container with respect to the process cartridge.

In the above-described exemplary embodiments, the first information is the toner remaining amount information indicative of the remaining amount of the toner in the toner container. However, the first information is not limited thereto. The first information may be any information as long as the information is "information relating to the use amount of the toner in the toner container," such as the number of times of cumulative use of the photoconductor drum, the total amount of print area coverage, information indicative of the use amount of the toner in the toner container, information relating to the recovery amount of the toner in the toner recovery container, or a flag indicative of that the toner container is unused.

In the above-described exemplary embodiments, the second information is the drum cumulative use information indicative of the cumulative use amount of the photoconductor drum in the drum unit. However, the second information is not limited thereto. The second information may be any information as long as the second information is "information relating to the use amount of the drum unit," such as information indicative of the remaining use amount of the photoconductor drum in the drum unit.

In the above-described exemplary embodiments, the image holding portion is the drum unit DU in which the toner-image forming and holding section, the cleaner, the recovery toner housing box, the container mount portion, and the toner feeder 74 are installed. However, the image holding portion is not limited thereto. The image holding portion may include any component as long as the component does not include the toner container and includes at least the photoconductor drum from among the components installed in the process cartridge.

In the above-described exemplary embodiments, the body memory serving as the housing storage or the apparatus storage stores the drum cumulative use information and the drum unit flag serving as the second information. However, the housing storage or the apparatus storage is not limited thereto, and may store both the first information and the second information.

In the above-described exemplary embodiments, the information update unit updates the drum cumulative use information in the cartridge memory every time when an image is formed and writes the backup of the drum cumulative use information in the body memory; and the information update unit updates the toner remaining amount information in the cartridge memory every time when the toner is fed. However, the function of the information update unit is not limited thereto. The information update unit may frequently update one of the body memory and the cartridge memory and less frequently write the backup of the other.

In the above-described exemplary embodiments, the container storage stores the toner container flag indicative of whether or not the toner container TC is unused and the drum unit flag indicative of whether or not the drum unit DU is unused, in addition to the toner remaining amount information indicative of the remaining amount of the toner in the toner container and the drum cumulative use information indicative of the cumulative use amount of the photoconductor drum in the drum unit. However, the container storage is not limited thereto, and may not store the toner container flag or the drum unit flag.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing;

an image holding body that is housed in the housing and holds a toner image;

an image forming unit that is housed in the housing and forms the toner image on the image holding body;

a cartridge that includes at least the image holding body and is removably mounted on the housing;

a toner container that is removably mounted on the cartridge, houses a toner therein, and supplies the toner to the image forming unit;

a retaining mechanism that retains the toner container with respect to the cartridge;

a releasing mechanism that at least allows the toner container retained by the retaining mechanism to be released while the cartridge is mounted on the housing, and remains in the housing when the cartridge is removed from the housing;

a container storage that is installed on the toner container and stores first information relating to a use amount of the toner in the toner container and second information relating to a use amount of an image holding portion, which is a component not including the toner container and including at least the image holding body from among components installed in the cartridge;

a housing storage that stores at least the second information and remains in the housing when the cartridge is removed from the housing;

an information update unit that updates the first information in accordance with use of the toner in the toner container, and updates the second information in accordance with use of the image holding portion; and an information write unit that writes the second information stored in the housing storage into the container storage if the first information stored in the container storage indicates that the toner in the toner container is unused and the second information stored in the container storage indicates that the image holding portion is used.

2. The image forming apparatus according to claim 1, further comprising a use inhibit unit that inhibits use of the cartridge if the first information stored in the container storage indicates that the toner in the toner container is used and the second information stored in the container storage does not correspond to the second information stored in the housing storage.

3. The image forming apparatus according to claim 1, wherein the information write unit writes the second information stored in the container storage into the housing storage if the first information stored in the container storage indicates that the toner in the toner container is used.

4. A cartridge comprising:

an image holding body that holds a toner image;

a cartridge housing that includes at least the image holding body and is removably mounted on the image forming apparatus;

a toner container that is removably mounted on the cartridge housing, houses a toner therein, and supplies the toner to an image forming unit that forms the toner image on the image holding body;

a retaining mechanism that retains the toner container with respect to the cartridge housing, the retained state of the toner container at least being allowed to be released by a releasing mechanism arranged in the image forming apparatus while the cartridge housing is mounted on the image forming apparatus; and a container storage that is installed on the toner container, and stores first information relating to a use amount of the toner in the toner container and second information relating to a use amount of an image holding portion, which is a component not including the toner container and including at least the image holding body from among components installed in the cartridge housing, at least the second information also being stored in an apparatus storage remaining in the image forming apparatus when the cartridge housing is removed from the image forming apparatus, the second information stored in the apparatus storage being written into the container storage if the first information stored in the container storage indicates that the toner in the toner container is unused and the second information stored in the container storage indicates that the image holding portion is used.

* * * * *